US011643256B2

(12) United States Patent
Bunnik et al.

(10) Patent No.: US 11,643,256 B2
(45) Date of Patent: May 9, 2023

(54) STORAGE DEVICE

(71) Applicant: TANOS GmbH Verpacken Ordnen Präsentieren, Illertissen (DE)

(72) Inventors: Edwin Bunnik, Ulm (DE); Tjeerd Gerbranda, Leipheim (DE); Bas Boon, Essen (DE)

(73) Assignee: TANOS GmbH Verpacken Ordnen Praesentieren, Illertissen (DE)

( * ) Notice: Subject to any disclaimer, the term of this patent is extended or adjusted under 35 U.S.C. 154(b) by 0 days.

(21) Appl. No.: 17/275,834

(22) PCT Filed: Sep. 14, 2018

(86) PCT No.: PCT/EP2018/074917
§ 371 (c)(1),
(2) Date: Mar. 12, 2021

(87) PCT Pub. No.: WO2020/052781
PCT Pub. Date: Mar. 19, 2020

(65) Prior Publication Data

US 2022/0041342 A1 Feb. 10, 2022

(51) Int. Cl.
*B65D 43/16* (2006.01)
*B65D 21/02* (2006.01)
*B25H 3/02* (2006.01)

(52) U.S. Cl.
CPC ..... *B65D 43/16* (2013.01); *B65D 21/0209* (2013.01); *B25H 3/02* (2013.01)

(58) Field of Classification Search
CPC ..... B65D 43/16; B65D 21/0209; B25H 3/02
USPC ..... 206/372; 292/190; 180/69.2
See application file for complete search history.

(56) References Cited

U.S. PATENT DOCUMENTS

| | | | | |
|---|---|---|---|---|
| 1,858,539 | A | 5/1932 | Dewey | |
| 1,998,600 | A * | 4/1935 | Weber | B65D 43/16 217/56 |
| 9,776,773 | B1 | 10/2017 | Chen | |
| 2007/0095690 | A1* | 5/2007 | Nguy | B25H 3/006 206/372 |
| 2008/0099546 | A1 | 5/2008 | Cronin et al. | |
| 2018/0015938 | A1 | 1/2018 | DeFrancia | |
| 2019/0039781 | A1* | 2/2019 | Kögel | B25H 3/02 |

FOREIGN PATENT DOCUMENTS

| | | |
|---|---|---|
| EP | 1442845 | 8/2004 |
| EP | 1442845 A1 | 8/2004 |
| EP | 2485874 | 8/2012 |
| EP | 2485874 B1 | 8/2012 |

* cited by examiner

*Primary Examiner* — Rafael A Ortiz
*Assistant Examiner* — Sanjidul Islam
(74) *Attorney, Agent, or Firm* — Hoffmann & Baron, LLP

(57) ABSTRACT

A storage device including at least one storage container provided with a container housing, which has a housing lower part and a housing cover swivellably mounted on the housing lower part in the region of the rear side. On the underside of its two lateral cover edge sections, the housing cover has a respective centring strip projecting downwards, wherein these centring strips protrude into the housing lower part when closing the housing cover in such a way that, via transverse support occurring relative to the housing lower part, they ensure that the housing cover is guided into a closed position that is centred relative to the housing lower part.

21 Claims, 10 Drawing Sheets

STORAGE DEVICE

This application claims priority based on an International Application filed under the Patent Cooperation Treaty, PCT/EP2018/074917, filed on Sep. 14, 2018.

BACKGROUND OF THE INVENTION

The invention relates to a storage device with at least one storage container which comprises a container housing which has an at least essentially rectangular outline and which has a height direction which runs between a lower side and an upper side, a longitudinal direction which runs between a front side and a rear side and is at right angles to the height direction and a transverse direction which is at right angles to the height direction as well as to the longitudinal direction, wherein the container housing comprises a housing lower part which delimits a storage space and which has a base wall and a peripheral wall, said peripheral wall projecting upwards from the edge of the base wall in the height direction and consisting of a front wall, of a rear wall which is distanced with respect to the front wall in the longitudinal direction and of two side walls which are distanced to one another in the transverse direction, wherein an upper end section of the peripheral wall frames an access opening for the storage space, and wherein the container housing further comprises a housing lid, said housing lid being pivotably mounted on the housing lower part in the region of the rear side about a pivot axis running in the transverse direction and by way of a pivoting effected relative to the housing lower part being able to be selectively brought into a closure position which closes the access opening or into opening positions which are pivoted upwards to a greater or lesser extent whilst releasing the access opening and above one of each side wall of the housing lower part comprising a lateral lid edge section, on whose lower side a downwardly facing lower edge surface is formed, said edge surface in the closure position at least partly covering an upwardly facing upper edge surface of the side wall of the housing lower part which is arranged therebelow.

A storage device of this type which is known from EP 2 485 874 B1 comprises a storage container whose container housing consists of a box-like housing lower part and of a housing lid which is pivotably mounted thereon in the region of the rear side. The housing lid can be pivoted into a closure position, in which it lies on an upper end section of a peripheral wall of the housing lower part and closes an access opening for an internal storage space of the container housing. For inserting or removing objects into and out of the storage space respectively, the housing lid can be pivoted in a stepless manner into a multitude of open positions, in which it pivoted upwards to a greater or lesser extent and releases the access opening. In the closure position, the housing lid and the housing lower part slightly overlap in the height direction of the container housing, in order to stiffen out the housing structure. If the storage container is opened whilst it is placed on an uneven surface, a distortion can occur on account of receiving compartments which are formed in the lower part and are provided for receiving information carrier cards, and this can compromise the subsequent closing procedure of the housing lid.

SUMMARY OF THE INVENTION

It is the object of the invention to provide measures in order, with regard to a storage container of a storage device, to minimise problems on actuating the housing lid which arise from distortion.

For achieving this object, in combination with the aforementioned features, one envisages that the housing lid on the lower side of each of its two lateral lid edge sections comprises a centring strip which projects downwards beyond the lower edge surface and extends in the longitudinal direction of the container housing, said centring strip during a closing pivoting of the housing lid, which assumes an open position, immerses from above into the housing lower part next to the adjacent side wall on the inner side facing the storage space and past the upper edge surface of the side wall with an overlapping with respect to the side wall which increases from the rear side to the front side, wherein the housing lid can be guided by the centring strips, which are supportable or supported on the respectively adjacent side wall in the transverse direction, into a closure position which is centred with respect to the housing lower part.

In this manner, a reliable closure procedure of the housing lid which assumes an open position becomes possible largely independently of possible a distortion of the housing lower part. The centring strips function as closure aids which even with a housing lower part which is prone to distortion permit a problem-free closing of the housing lid. From this, amongst other things arises the advantage that with the design of the housing lower part, one does not need to pay particular attention to the maintenance of a high torsional stiffness, and in particular there is the possibility of keeping the wall thickness as small as possible for the benefit of a lower container weight. On pivoting the open housing lid into the closure position, the centring strips which are arranged on the lateral edge sections of the housing lid immerse from above into the housing lower part, wherein they are moved into a region which is adjacent to the side walls of the housing lower part at the inner side which faces the receiving space. Preferably, on closing the housing lid, the centring strips immerse through the access opening into the storage space. The immersing procedure takes place gradually, and specifically with a height-related overlapping between the centring strips and the respectively assigned side wall of the housing lower part, said overlapping increasing from the rear side to the front side of the container housing. Since a possible distortion of the housing lower part in the region of the pivot axis does not have a significant effect upon the relative position between the housing lid and the housing lower part on account of the housing lid which is articulated there in a direct manner, the centring strips immerse into the housing part in an uninhibited manner at the beginning of the closure procedure, if they are not in any case already immersed into the housing lower part on account of the small opening angle. Given the continued closing pivoting of the housing lid, the centring strips which towards the front increasing immerse into the housing lower part exert a transverse force upon side walls of the housing lower part which are possibly set obliquely on account of distortion, so that an exact parallel alignment is effected, which finally leads to the housing lid getting into the closure position in a relative position which is centred with respect to the housing lower part.

If, during a closure procedure, the housing lower part and the housing lid are aligned exactly to one another on account of a receiving container being placed on a level surface, the centring strips can immerse into the housing lower part without exerting a significant transverse force onto the side walls of the housing lower part. Preferably, the centring strips are arranged such that a minimal transverse distance between the side walls of the housing lower part and the centring strips is present in the closed state of the housing lid, so that the centring function indeed only occurs if a certain distortion is present. The design however can also be made to the extent that the centring strips basically bear on the inner surfaces of the side walls of the housing lower part. Given a closed housing lid, the centring strips can contribute to the stiffening of the complete structure of the container housing and to the prevention of distortion when the closed container housing is placed onto an uneven surface or when the storage space is asymmetrically occupied with one or more heavy objects.

Advantageous further developments of the invention are to be derived from the dependent claims.

The two centring strips at their rear side which faces the rear side of the container housing are expediently chamfered and/or rounded, in a manner such that their rear terminating edge has a course which is directed downwards and at the same time to the front in the direction of the front side of the container housing. Amongst other things, this permits the centring strip to be brought relatively closely onto the container rear side.

Preferably, each centring strip is designed with such a length that considered in the closure position of the housing lid, it has a rear terminating edge which is arranged adjacently to the rear wall of the housing lower part and a front terminating edge which is arranged adjacently to the front wall of the housing part. Preferably, the length of each centring strip corresponds essentially to the length of the storage space which is measured between the front wall and the rear wall.

It is seen as being advantageous if the height of each centring strip which is measured in the height direction of the container housing gradually reduces to the front towards the front side of the container housing, this being in a manner such that the height-related protrusion of each centring strip with respect to the lower edge surface which is located on the same lateral lid edge of the housing lid reduces towards the front side of the container housing. Herewith, amongst other things, one takes into account the fact that the transverse forces which are to be exerted onto the side walls for the centring are no longer particularly high in the front region of the container housing, since the predominant centring has already been carried out by the rear length section of the centring strips on closing the housing lid.

It is further advantageous if each centring strip on its lower longitudinal side which faces the housing lower part comprises an introduction section which tapers downwards in the direction of the housing lower part and which is chamfered on the outer side which faces the adjacent side wall. This permits the centring strips to be arranged very closely to the side walls of the housing lower part in the transverse direction of the container housing without inhibiting the vertical threading of the centring strips into the housing lower part on closing the housing lid. The introduction section preferably extends over the complete length of the respective centring strip.

Each centring strip preferably has a flat shape. For example, it is designed in a strip-like or slat-like manner. The thickness of the centring strip which is measured in the transverse direction of the container housing is smaller than its height which is measured in the height direction of the container housing and which width is turn is smaller than the length of the centring strip which is measured in the longitudinal direction of the container housing. The centring strip is aligned such that its main extension plane runs at least essentially at right angles to the transverse direction of the container housing.

It is considered as being expedient if the centring strips are shaped such that at least in an open position of the housing lid which is pivoted upwards by 45 degrees with respect to the housing lower part they are located completely outside the housing lower part. Concerning an advantageous design, the centring strips are designed such that they immerse into the housing lower part at least in the complete pivoting region between the closure position and an open position of the housing lid which is pivoted upwards by 30 degrees. The earlier the centring strips immerse into the housing lower part on closure of the housing lid, as a rule, the more effective is the desired centring function.

As already mentioned, the centring strips with the outer surface of their section which immerses into the storage space, said outer surface facing the respectively adjacent side wall of the housing lower part, can bear in a slidingly displaceable manner on the inner surface of the adjacent side wall of the housing lower part, said inner surface facing the storage space. This bearing contact can basically be present due to the container housing being designed such that the slidingly displaceable contact already occurs even in the non-distorted or non-deformed neutral state of the container housing. However, it is seen as being more advantageous if the design is made such that a slight distance is present between the centring strip and the adjacent side wall in the non-deformed neutral state of the container housing and a slidingly displaceable contact between these components does not occur until the housing lower part is at least slightly distorted.

Concerning an expedient design of the housing lower part, the upper edge surface of each side wall has a stepped cross-sectional contour, so that it is composed of at least two and in particular of precisely two edge surface sections which are arranged next to one another in the transverse direction of the container housing and which are furthermore arranged offset to one another in the height direction of the container housing. An inner upper edge surface section which is arranged closer to the storage space is preferably distanced further to the base wall of the container lower part than an outer upper edge surface section of the upper edge surface which distanced further from the storage space. For avoiding redundancies, the housing lid is preferably designed such that in the closure position it only lies on one of the two upper edge surface sections, in particular on the inner upper edge surface section. In the closure position of the housing lid, the centring strips project downwards past all upper edge surface sections into the housing lower part and herein preferably into the receiving space.

In order for the centring strip to be able to be designed in a relatively thin manner so as to save material, but despite this to have a high stiffness, it is advantageous if several stiffening webs which are arranged at a distance to one another in the longitudinal direction of the respective centring strip are integrally formed on the inner surfaces of the two centring strips which face one another. These stiffening webs as with the centring strips are expediently an integral constituent of the single-piece housing lid.

The housing lower part as well as the housing lid is expediently manufactured of a plastic material. In particular, it is the case of injection moulded parts. On manufacture of the housing lid, the centring strips are co-manufactured in a direct manner, so that they are integrated into the housing lid as one piece.

In an advantageous design of the storage device, the housing lid of at least one and preferably of each storage container is provided on the lower side of its two front corner regions with a downwardly projecting centring pin.

The two corner regions lie between the two lateral lid edge sections and the front lid edge section of the housing lid which is arranged above the front wall of the housing lower part. In the end phase of a closing procedure of the housing lid, the centring pins immerse from above into the housing lower part, wherein they are arranged such that they can support themselves on the peripheral wall of the housing lower part at right angles to the height direction of the container housing. In this manner, the housing lid which is located in the closure position is supported with respect to the housing lower part with a greater stability. The result of this is a particularly exactly centred closure position of the housing lid, wherein the centring strip are relieved of loading by transverse forces in the closure position of the housing lid.

Preferably, a centring recess which is open to the top and into which the assigned centring pin immerses from above in the closure position of the housing lid is formed at the inside on the peripheral wall of the housing lower part for each centring pin. Each centring recess is preferably located in the corner region between the front wall and one of the two side walls of the housing lower part.

Each centring pin is expediently arranged at a distance in front of the adjacent centring strip in the longitudinal direction of the container housing. The centring pins can be shaped in an arbitrary manner, for example with a round cross section or with a flat cross section. Furthermore, the centring pins can be desired in a single-part manner as well as in a longitudinally subdivided manner, wherein however at all events they are preferably attached to the housing lid as one piece.

Preferably, the container housing is designed such that the housing lid can be releasably locked with the housing lower part in the closure position. Corresponding locking means are expediently located on the front side of the container housing at the outside. They comprises for example a rotary bar which is mounted on the housing lid at the outside For the manual handling of the at least one storage container, in particular for carrying the storage container, it is advantageous if the container housing at the outside on the upper side of the housing lid comprises an upper handle, around which a hand can grip. This upper handle can basically be designed in a rigid manner, but is expediently pivotably mounted on the housing lid in a manner such that it can be selectively pivoted into a position of non-use which is pivoted onto the housing lid or into a position of use which is pivoted away from the housing lid and projects upwards.

Additionally or alternatively, the container housing can comprise a front handle on the front wall of the housing lower part at the outside. The front handle can be attached to the container housing in an immovable manner, but is preferably pivotably mounted so that it can be selectively positioned in a position of non-use which is pivoted onto the housing lower part or in a position of use which is pivoted away from the housing lower part and projects upwards.

An optimal variability on handling a storage container is given if an upper handle as well as a front handle is arranged on the container housing.

In an advantageous design, the storage device comprises a shelf structure, in which the at least one storage container can be received in a manner in which it can pulled out whilst not in non-use. In this context, it is advantageous if the storage container on the outer side of the container housing, in particular on the lower side comprises a guide device which fits together with a counter guide device which is arranged on the shelf structure and which likewise belongs to the storage device. Preferably, the guide device as well as the counter guide device are structured in a rail-like manner and engage into one another in a linearly displaceable manner, which favours a smooth pulling-out or insertion of the storage container out of and into the shelf structure respectively.

The storage device can comprise only a single storage container. However, it is advantageous if it comprises several storage containers which are stackable onto one another in the height direction of each storage container. By way of this, they can be mounted in a space-saving manner. The container housings of the several storage containers amongst one another preferably have the same rectangular outline. Amongst one another they can have the same or a different height.

It is advantageous if each of the several stackable storage containers comprises a lower coupling device on its container housing in the region of the lower side and an upper coupling device in the region of the upper side, wherein these two coupling devices are adapted to one another in a manner such that storage containers which are directly stacked onto one another in a height direction can be releasably coupled to one another in a manner in which they cannot be lifted from one another, by way of the interaction of the upper coupling device of the respective lower storage container and of the lower coupling device of the respective upper storage container.

Inasmuch as the storage container is provided with locking means for locking the closure position of the housing lid, it is advantageous if these locking means fulfil a multi-function and are also designed as constituents of at least one of the two coupling devices.

BRIEF DESCRIPTION OF THE DRAWINGS

The invention is hereinafter explained in more detail by way of the accompanying drawings. In these are shown in.

DETAILED DESCRIPTION

Figure 1:
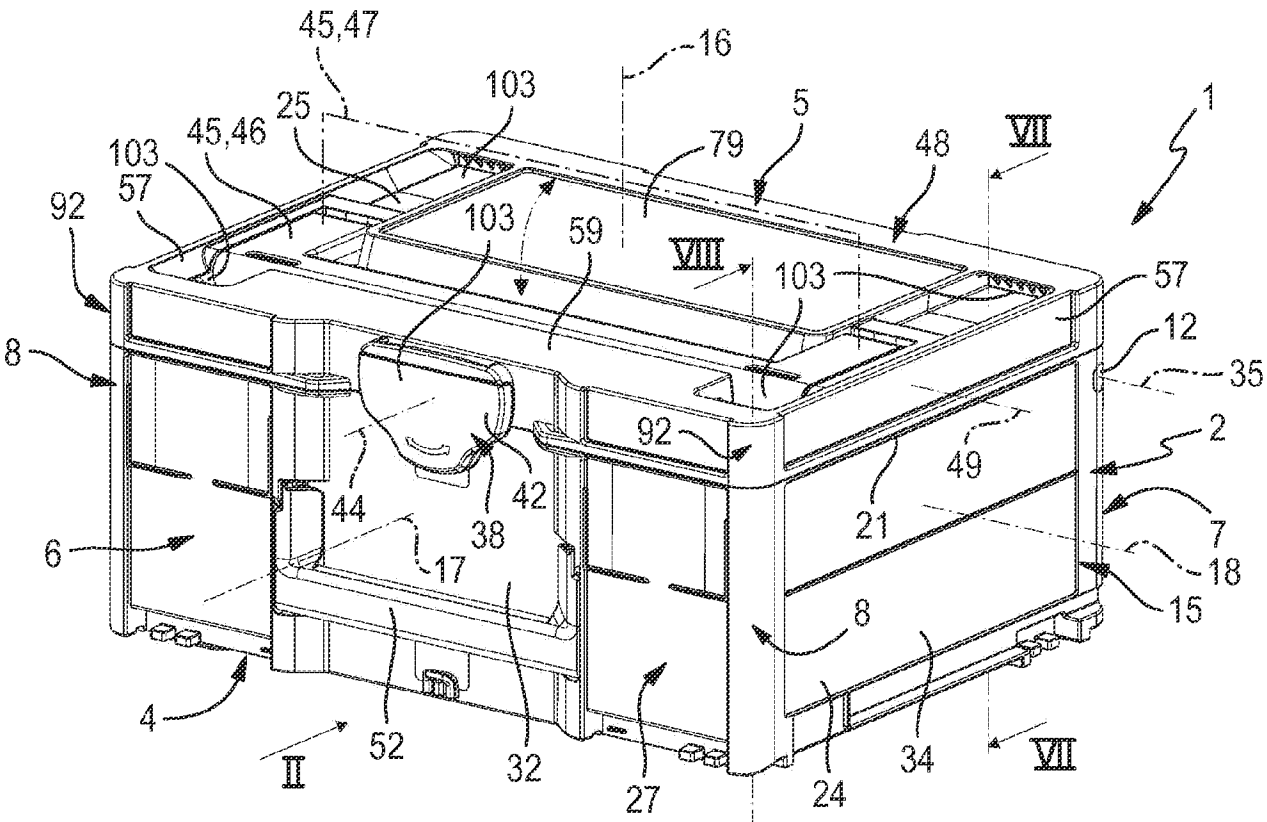
FIG. 1 a preferred first embodiment of the storage device according to the invention, with a perspectively drawn storage container which is shown with the closure position of its housing lid, FIG. 2 a front view of the storage container of FIG. 1 with a viewing direction according to arrow II of FIG. 1, FIG. 3 a further perspective representation of the storage container which is evident from FIGS. 1 and 2, with a housing lid which is pivoted into an open position, wherein a detail of the storage container which is framed in a dot-dashed manner is also drawn separately once again in an enlarged manner, FIG. 4 a lateral view of the storage container with a viewing direction according to arrow IV of FIG. 3, wherein various relative positions of a centring strip which are assumed with respect to the housing lower part in dependence on the different pivoting positions of the housing lid are illustrated in a dot-dashed manner, FIG. 5 a further perspective representation of the storage container of FIGS. 1 to 4 in a maximally open position of the housing lid, FIG. 6 the arrangement of FIG. 5 from a more greatly inclined viewing angle from above, FIG. 7 a cross section of the storage container according to section line VII-VII of FIG. 1, wherein a sections which is framed in a dot-dashed manner is once again drawn separately in an enlarged manner, FIG. 8 a further cross section of the storage container according to section line VIII-VIII of FIG. 1, wherein here too a detail which is framed in a dot-dashed manner is once again drawn separately in an enlarged manner, FIG. 9 a horizontal section through the storage container at right angles to the height direction according to section planes IX-IX from FIG. 7, and FIG. 10 a container stack which consists of two storage containers of the storage device which stacked onto one another and are releasably coupled to one another in a manner in which they cannot be vertically lifted, wherein two storage containers which are designed identically disregarding a different construction height are drawn.

The storage device which is indicated in its entirety by the reference numeral 1 comprises one or more storage containers 2 whose basic construction is evident from FIGS. 1 to 9 in an advantageous design. FIG. 10 shows two storage containers 2 of the storage device 1 in a state in which they are stacked upon one another whilst forming a container stack 98 and which disregarding a different construction height are designed identically. The storage device 1 can basically also comprise only a single storage container 2.

Figure 6:
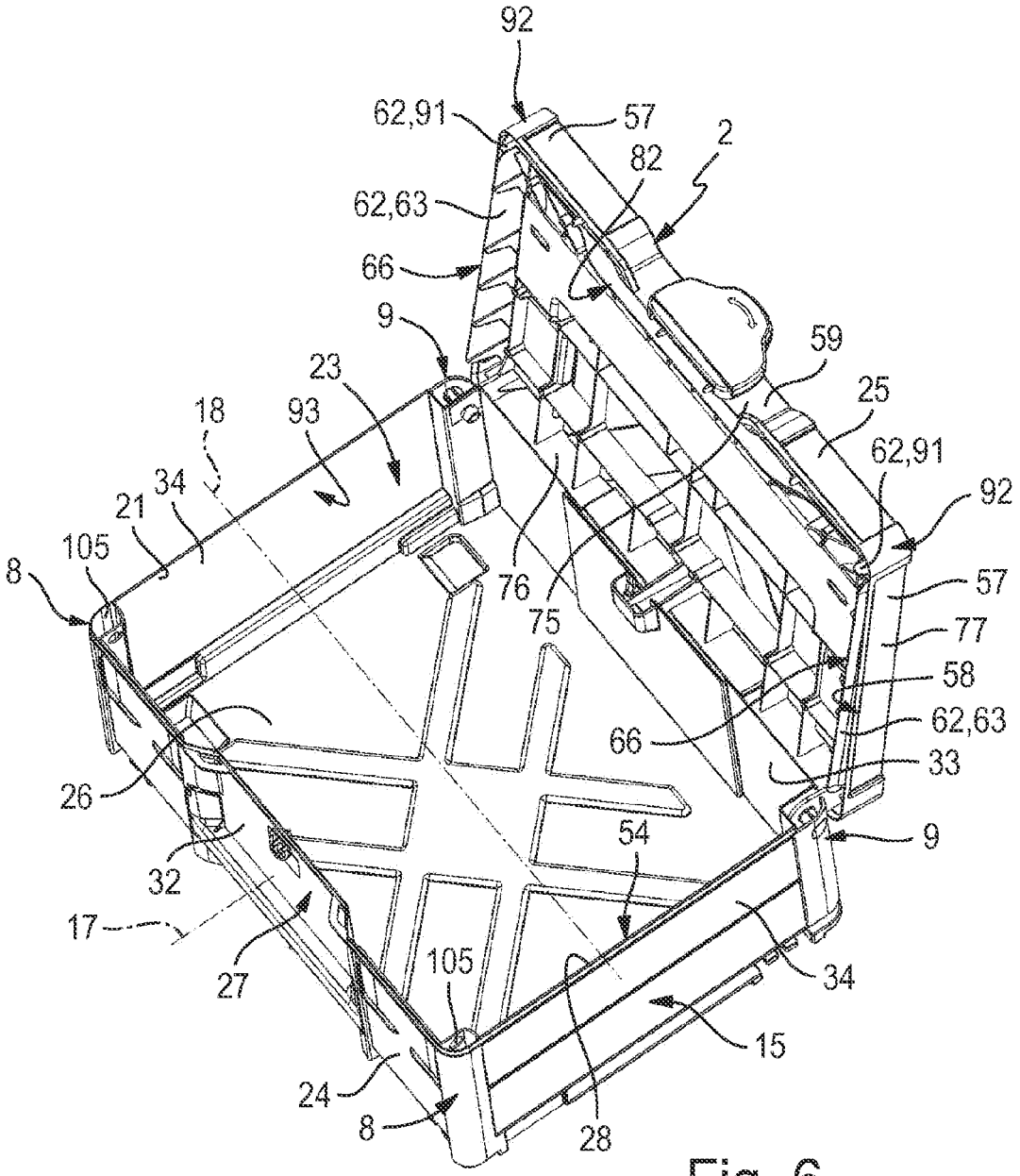
Figure 7:
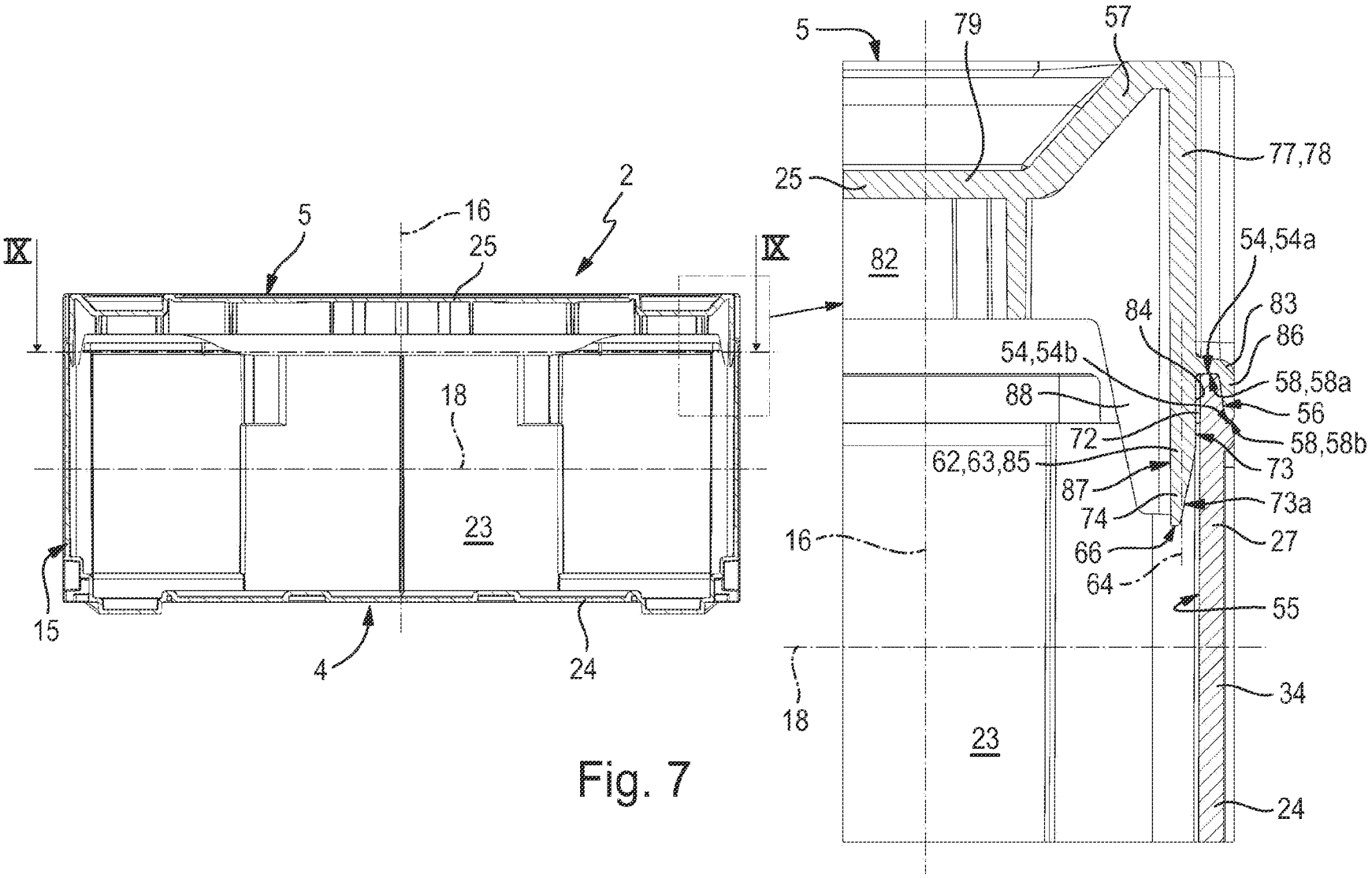
Figure 8:
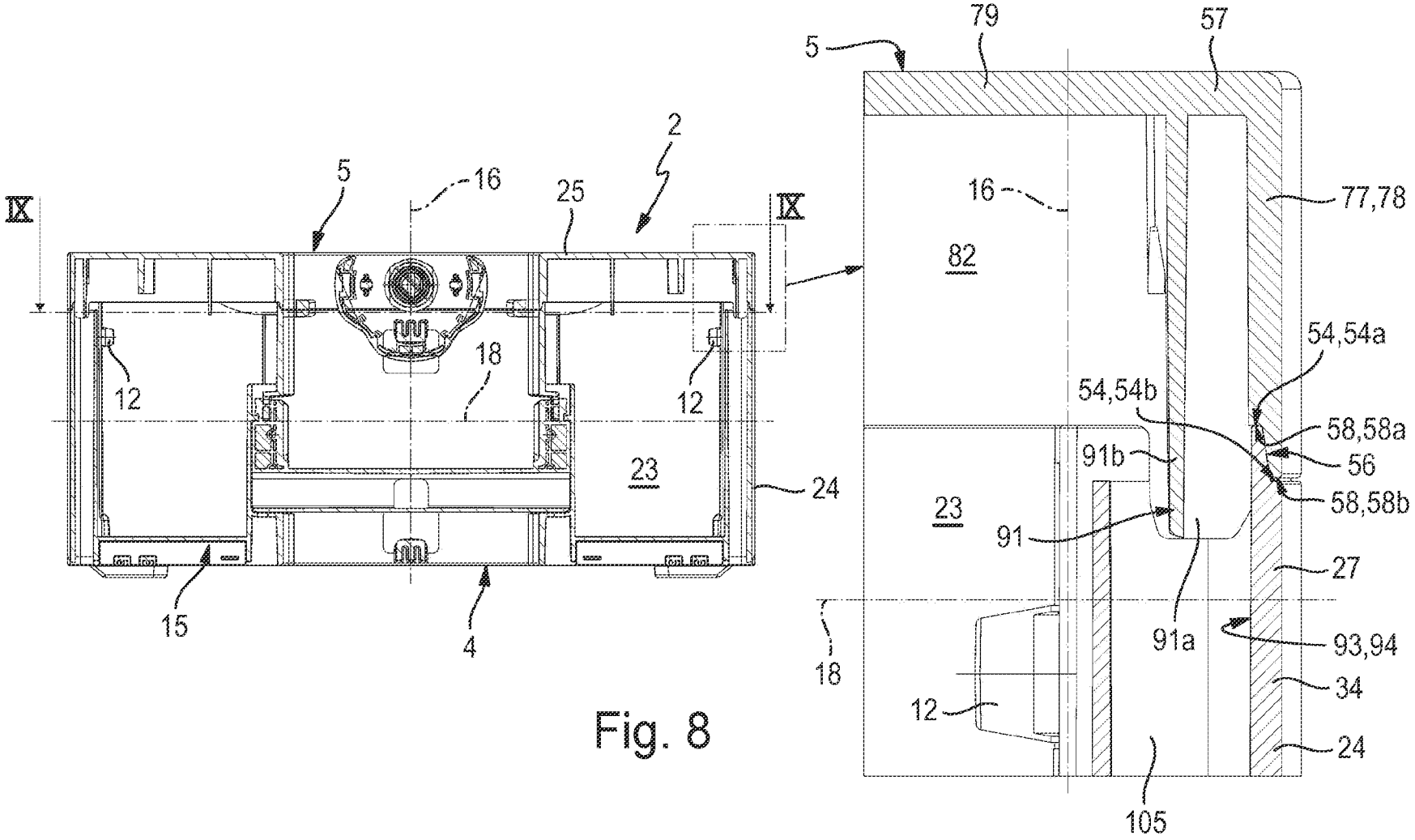
Figure 9:
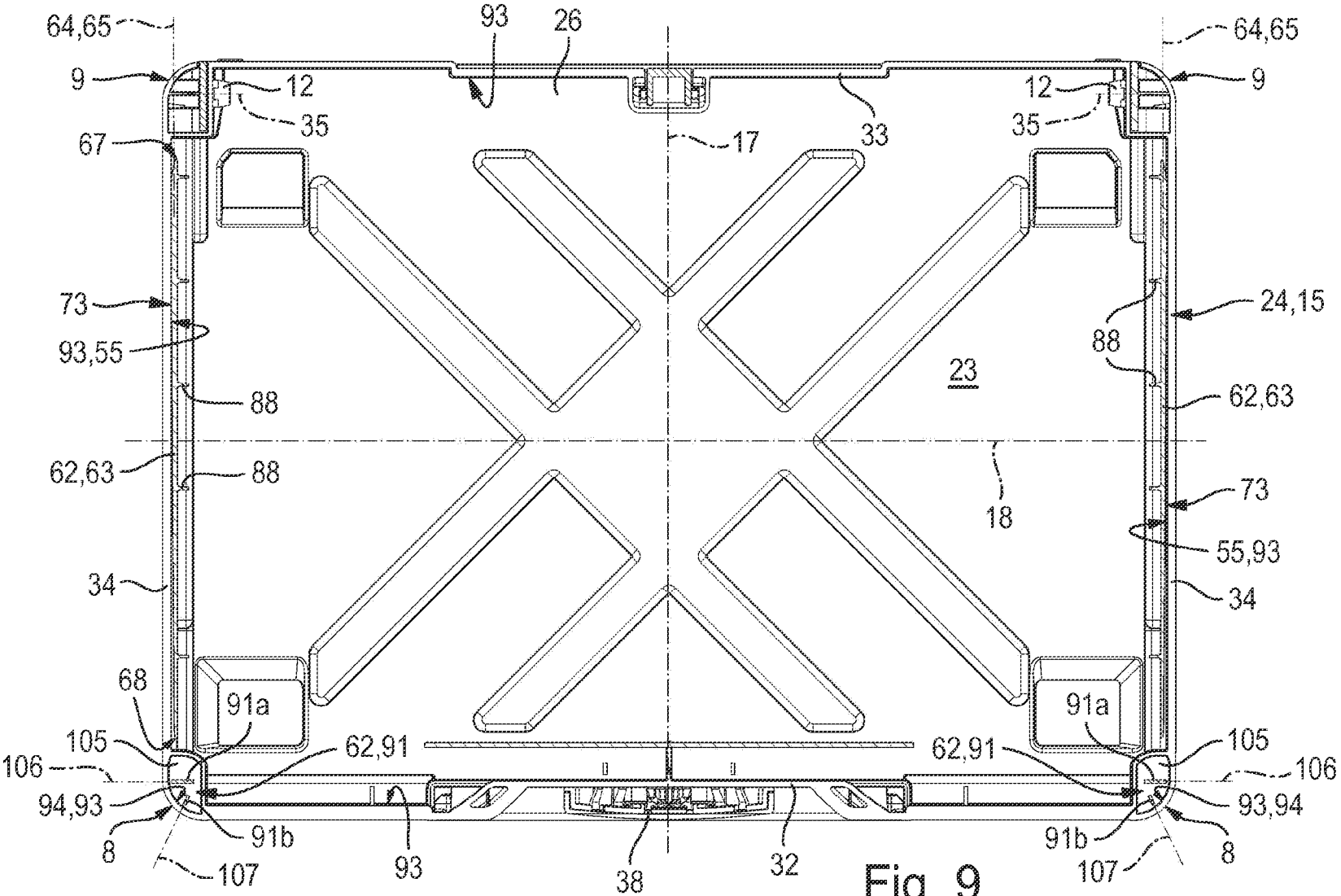
Figure 10:
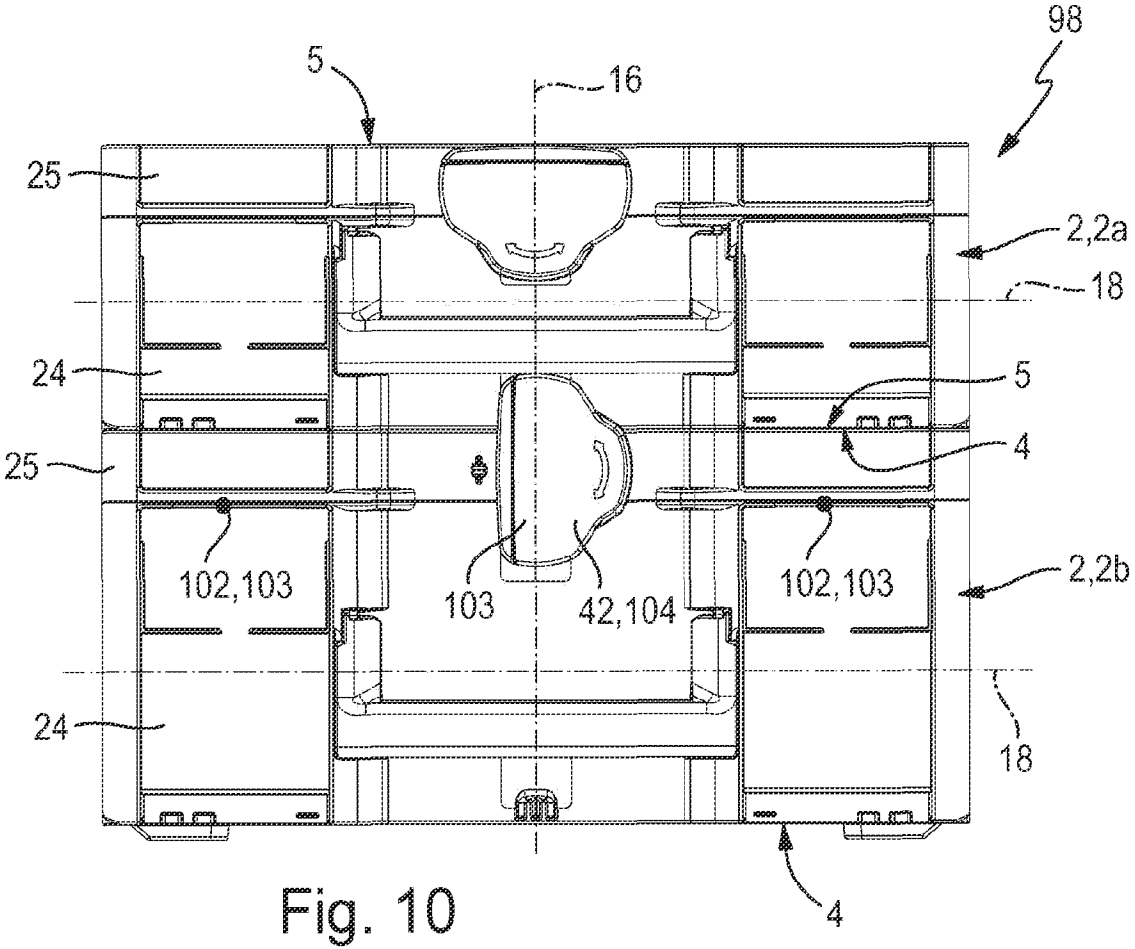

The storage container 2 comprises a container housing 15 with an at least essentially rectangular outline which is well evident from FIGS. 6 and 9.

The container housing 15 has a height axis 16 which extends between a lower side 4 and an upper side 5 and a longitudinal axis 17 which runs at right angles thereto, between a front side 6 and a rear side 7. Furthermore, it has a transverse axis 18 which is at right angles to the height axis 16 as well as to the longitudinal axis 17. The axis direction of the height axis 16 defines a height direction which is provided with the same reference numeral 16, wherein the axis direction of the longitudinal axis 17 defines a longitudinal direction 17 and the axis direction of the transverse axis 18 a transverse direction 18 of the container housing 15.

By way of example, the dimensions in the height direction 16 define a height, the dimensions in the longitudinal direction 17 a depth and the dimensions in the transverse direction 18 a width of the container housing 15.

The aforementioned rectangular outline runs in a plane which is at right angles to the height axis 16.

The container housing 15 has a preferably box-like housing lower part 24 and a housing lid 25 which is mounted on the housing lower part 24 in a pivotably movable manner. Together, the housing lower part 24 and the housing lid 25 delimit a storage space 23 which is envisaged for accommodating objects to be stored, for example tools and in particular electrical tools.

The housing lower part 24 has a base wall 26 which closes off the storage space 23 at the lower side 4 and a peripheral wall 27 which projects upwards from the outer edge of this base wall 26 in the height direction 16. The peripheral wall 27 annularly encompasses the storage space 23 about the height axis 16, wherein on its upper side which is opposite to the base wall 26 it comprises an upper end section 21 which frames an access opening 28 for the storage space 23. Objects can be inserted into the storage space 23 and be removed from the storage space 23 through the access opening 28.

The peripheral wall 27 which is of one piece with the base wall 26 is composed of a front wall 32 of a rear wall 33 which lies opposite to the front wall 32 in the longitudinal direction 17 and of two side walls 34. The side walls 34 lie opposite one another in the transverse direction 18 and connect the front wall 32 to the rear wall 33.

The front wall 32 merges as one piece into the two side walls 34 in two front corner regions 8 which are distanced to one another in the transverse direction 18. A connection which is of likewise of one piece is present between the rear wall 33 and the two side walls 34 at the two rear corner regions 9 of the peripheral wall 27.

The housing lid 25 is assigned to the access opening 28 and in the region of the rear side 7 is pivotably mounted on the housing lower part 24 relative to the housing lower part 24 about a pivot axis 35 which runs in the transverse direction 18. Preferably, the pivot bearing means 12 which define the pivot axis 35 are arranged at the rear corner regions 9 of the peripheral wall 27, in particular at only a small height distance to the access opening 28.

Figure 3:
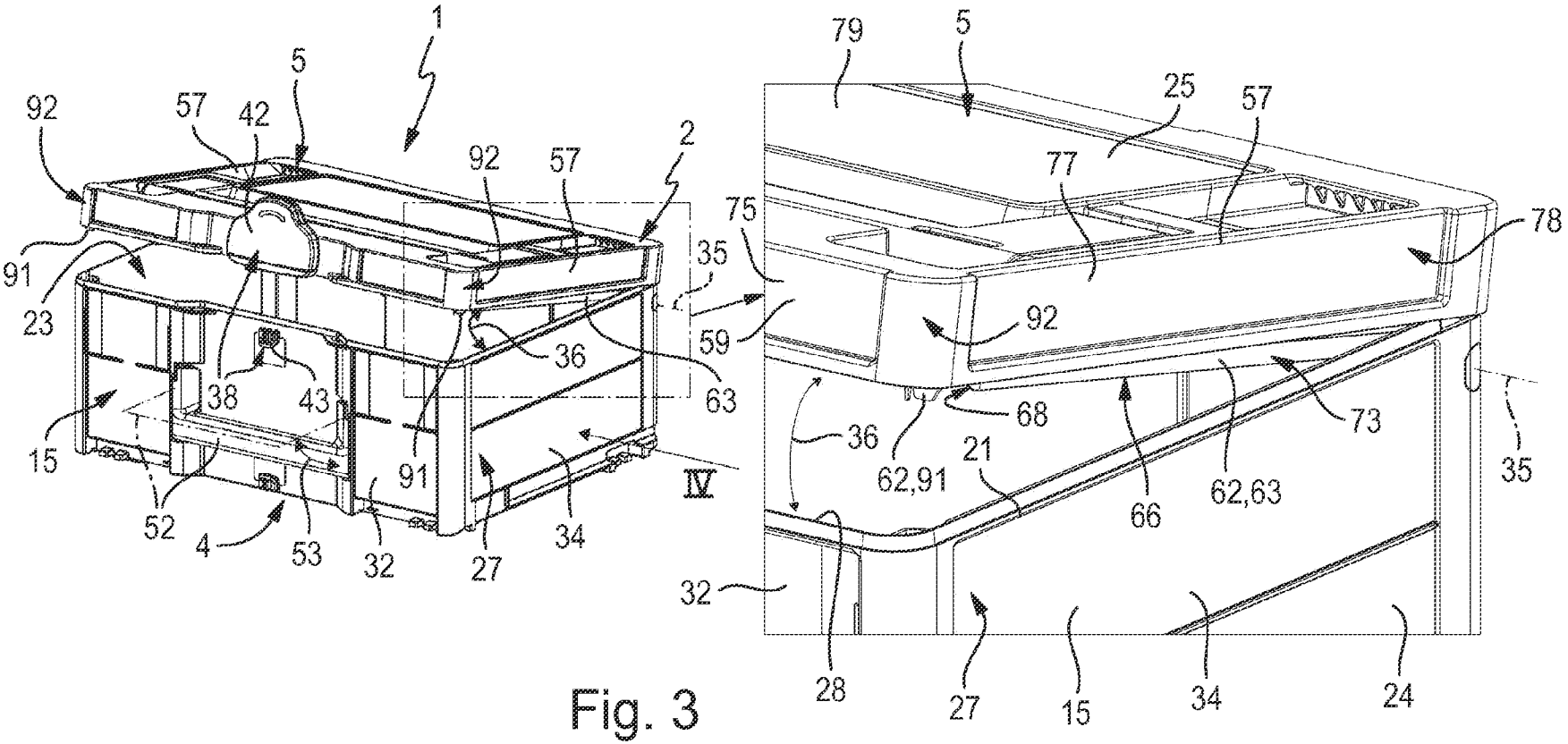
Figure 4:
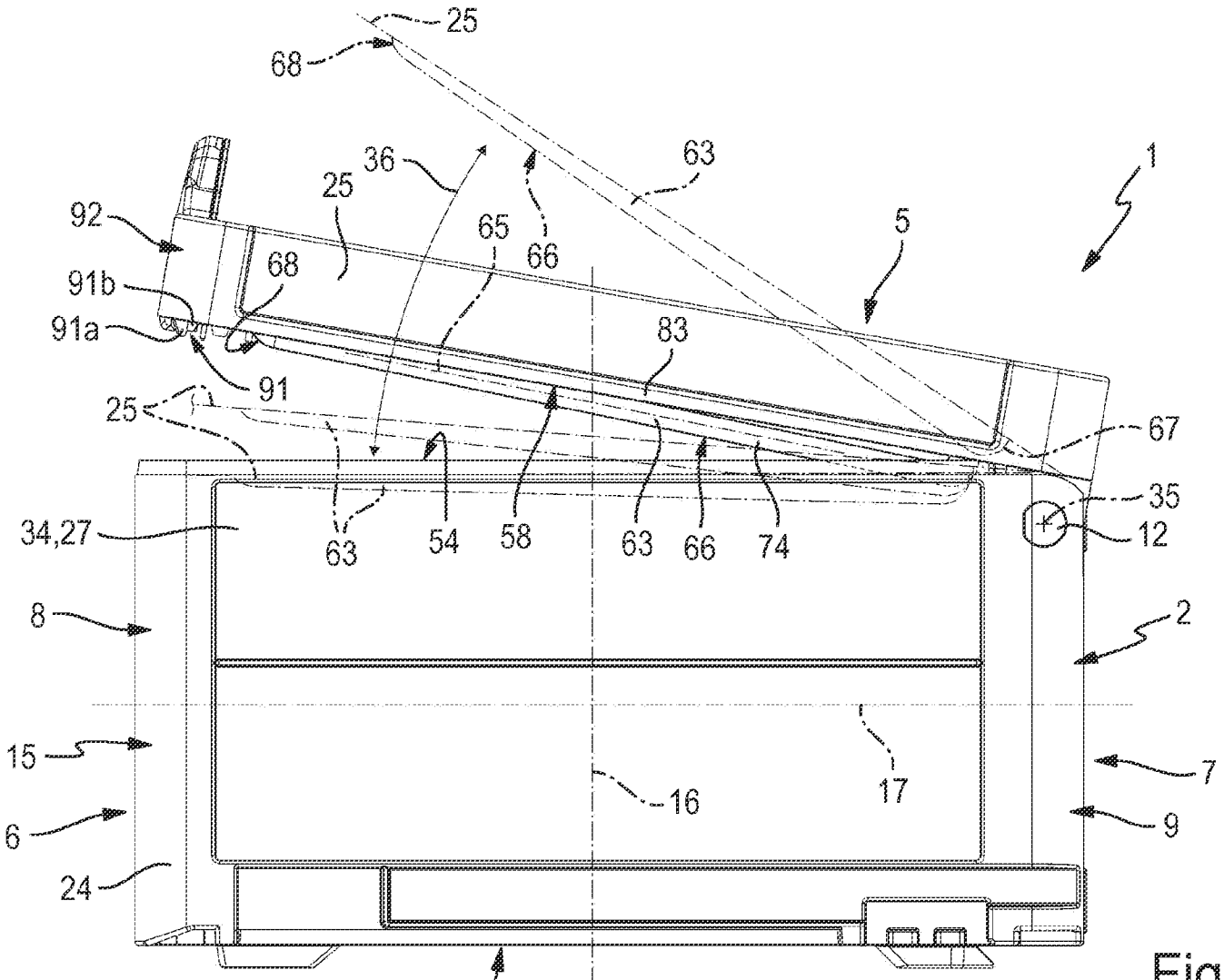
Figure 5:
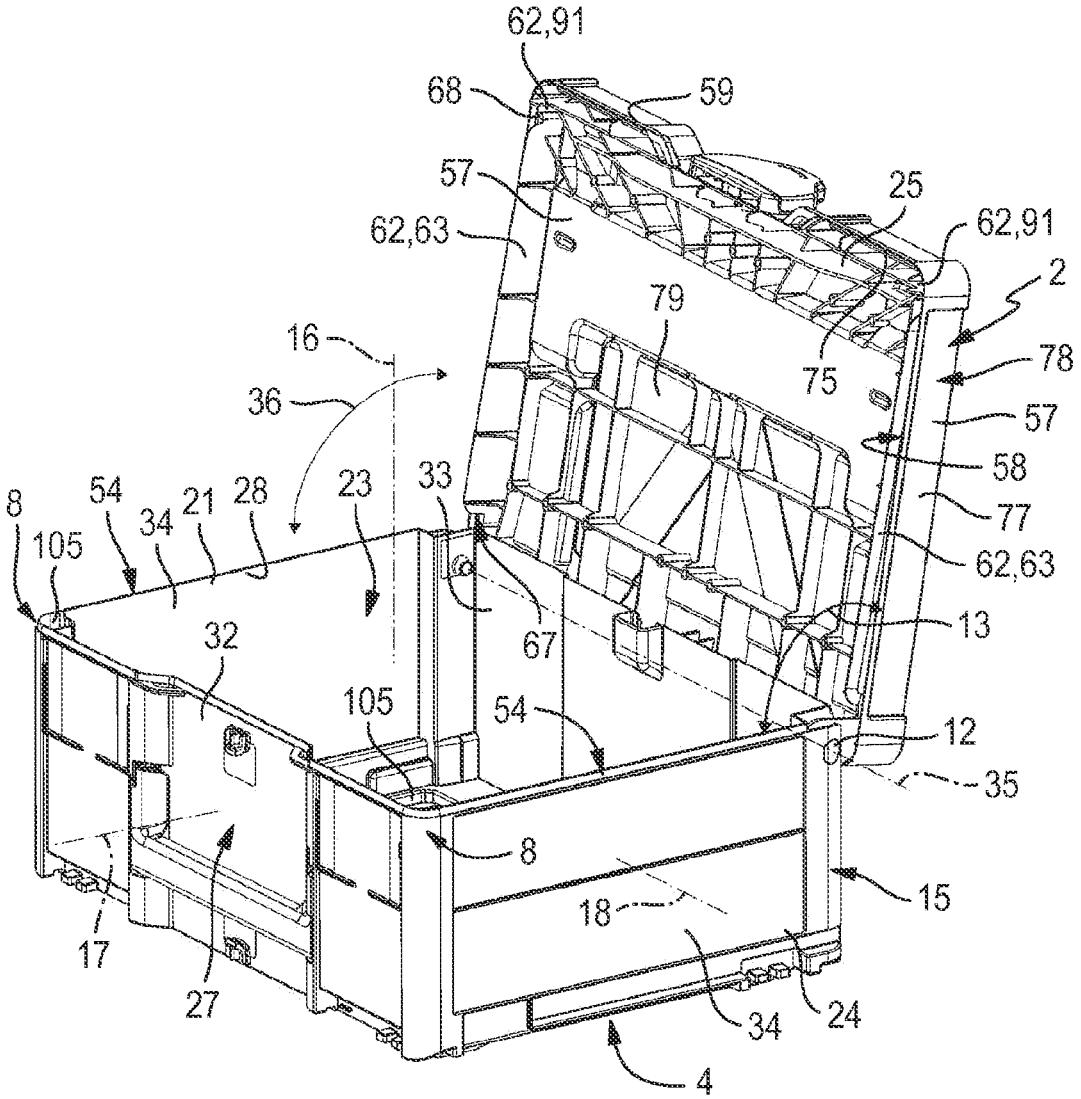

In the course of a pivoting movement 36 which is indicated in the drawing by a double arrow, the housing lid 25 can be selectively positioned in a closure position which closes the access opening 28 or in various open positions which are pivoted upwards to a greater or lesser extent. In the open positions, the access opening is accessible with an opening cross section which is differently large depending on the selected opening pivoting angle 13. Open positions of the housing lid 25 can be derived from FIGS. 3 to 6, wherein FIGS. 5 and 6 show a maximal open position with a maximal opening pivoting angle 13, whereas FIGS. 3 and 4 illustrate the housing lid 25 in an intermediate open position which lies between the closure position and the maximally open position.

In the closure position, the access opening 28 is covered by the housing lid 24 which is without openings.

The closure position of the housing lid 25 is expediently releasably lockable. For this, by way of example, suitable locking means 38 which can be actuated manually are located on the container housing 15 at the outside in the region of the front side 6. By way of example, the locking means 38 comprise a rotary bar 42 which is rotatably mounted on the housing lid 25 and a locking projection 43 which is arranged on the front wall 32 at the outside. The rotary bar 42 is rotatable about a rotation axis 44 which is parallel to the longitudinal axis 17 in the closure position of the housing lid 25 and in this manner can be selectively brought into or out of locking engagement with the assigned locking projection 43.

The housing lid 25 at the outside on the upper side 5 which is orientated in the height direction 16 is expediently provided with an upper handle 45. Preferably, the upper handle 45 is pivotable relative to the housing lid 25, so that it can be selectively positioned in a position of non-use 46 which is pivoted onto the container housing 15 or in at least one position of use 47 which is pivoted away from the housing lid 25 and which projects upwards. In the drawing, the position of use 47 of the upper handle 45 is only shown in FIG. 1 and is indicated there in a dot-dashed manner.

The pivot axis of the upper handle 45 is indicated in a dot-dashed manner at 49. It preferably runs in the transverse direction 18.

The upper handle 45 is preferably a bow grip with two grip limbs and a connection web, wherein it is pivotably mounted on the container housing 15, in particular on the housing lid 25 via the two grip limbs.

The upper handle 45 in the position of non-use 46 expediently assumes a position which is sunk in the housing lid 25 in a manner such that it does not project beyond an upper lid terminating surface 46 of the housing lid 25 which faces upwards in the height direction 16.

The storage container 2 which is illustrated by way of example comprises only a single storage space 23 which is closed by the housing lid 25 in a manner to be opened. Concerning an embodiment example which is not illustrated, at least one drawer which can be pulled out when required and which provides an addition storage space is yet arranged in the housing lower part 14.

It is advantageous if the container housing 15 at the outside on the front side 6 of the front wall 32 comprises a front handle 52. Concerning the embodiment example, such a front handle 52 is present additionally to the upper handle 45 but can also be provided alternatively to the upper handle 45.

As with the upper handle 45, the front handle 53 in principle can also be attached to the container housing 15 in a non-pivotably fixed manner. However, it is more advantageous if the front handle 52, as is realised with the embodiment example, is pivotable relative to the housing lower part 24 according to the double arrow 53. Then according to FIG. 3, it can be selectively positioned in a position of non-use which is pivoted onto the front wall 32 at the outside and in a position of use which is indicated in a dot-dashed manner in FIG. 3 and is pivoted away from the front wall 32 to the front.

The peripheral wall 27 of the housing lower part 24 on its upper side which faces upwards in the height direction 16 comprises an upper edge surface 54. The upper edge surface 54 extends annularly around the height axis 16 and consequently also in the longitudinal direction 17 along a respective side wall 34.

The upper edge surface 54 according to an embodiment example which is not illustrated can run exclusively in a plane which is at right angles to the height axis 16. In contrast, concerning the illustrated embodiment example, it has a stepped cross-sectional contour and is composed of two inner and outer upper edge surface sections 54*a*, 54*b* which are arranged next to one another in the transverse direction 18 and at the same time offset to one another in the height direction 16. The inner upper edge surface section 54*a* lies closer to the storage space 23 than the outer upper edge surface section 54*b* and at the two side walls 34 expediently merges directly into a side wall inner surface 55 of the side wall 34 which delimits the storage space 23.

A transition surface 54 between the two upper edge surface sections 54*a*, 54*b* which lie at a different height level, said transition surface being away from the storage space 23, is expediently inclined with respect to the height axis 16, so that it distances itself from the storage space 23 with an increasing approach onto the lower side 4.

The housing lid 25 comprises two lateral lid edge sections 57 which are opposite one another in the transverse direction 18 and which are each arranged above one of the two side walls 34 of the peripheral wall 27. A downwardly facing lower edge surface 58 is located on the lower side of one of each of these lid edge sections 57 which faces the housing lower part 24 and—when the housing lid 25 assumes the closure position—covers the upper edge surface 54 of the side wall 34 which is arranged therebelow. This can be easily recognised in the FIGS. 7 and 8.

The lower edge surface 58 of the lid edge sections 57 considered in cross section is expediently shaped complementarily to the assigned upper edge surface 54 of the side wall 34 which lies therebelow. For the embodiment example, this means that the lower edge surface 58 is also stepped and is composed of an inner lower edge surface section 58*a* which lies closer to the storage space 23 and of an outer lower edge surface section 58*b* which lies further to the outside. The inner lower edge surface section 58*a* is distanced further to the base wall 26 than the outer lower edge surface section 58*b*. An oblique transition surface whose inclination corresponds to the transition surface 56 between two upper edge surface sections 54*a*, 54*b* runs therebetween.

The stepped cross-sectional shape of the upper and lower edge surfaces 54, 58 has the effect that the housing lid 25 and the peripheral wall 27 overlap in the height direction 16 in the closure position.

In the closure position, the housing lid 25 expediently with its lower edge surface 58 lies at least partially on the upper edge surface 54 of the assigned side wall 34. Concerning the multi-stepped surface shaping of the embodiment example, this contact is preferably limited to one of the oppositely lying edge surface section pairings, wherein in particular one envisages the inner lower edge surface section 58*a* of the lid edge section 57 lying on the inner upper edge surface section 54*a* of the side wall 34 which is arranged therebelow.

On account of the outlined height-related overlapping between the housing lid 25 and the side walls 34 of the housing lower part 24, a positive supporting between the housing lid 25 and the housing lower part 24 in a horizontal plane which is at right angles to the height direction 16 and in particular in the transverse direction 18 results in the closure position. This counteracts a distortion of the box-like container housing 15.

If on use of the storage container 2 a distortion of the housing lower part 24 occurs in the open state, centring means 62 which are arranged on the housing lid 25 ensure that with the closing pivoting, the housing lid 25 is forcibly led into a closure position which is centred in the transverse direction 18 with respect to the housing lower part 24.

The centring means 62 comprise at least two centring strips 63, wherein such a centring strip 63 is arranged on the lower side of one of each of the two lateral lid edge sections 57. The centring strip 63 is integrally formed as one piece and is hence integrated as one piece into the housing lid 25 which consists of the plastic material. The housing lower part 24 otherwise likewise preferably consists of a plastic material.

Each centring strip 63 has a flat shape, wherein it is designed in a strip-like or slat-like manner. It is relatively thin in comparison to its length and to its width. It has a strip main plane 64 which is parallel to the two large-surfaced outer surfaces and is arranged on the housing lid 25 such that the strip main plane 64 is aligned at least essentially at right angles to the transverse axis 18.

The thickness of the centring strip 63 which is measured in the transverse direction 18 of the container housing 15 is smaller than the width which is measured in the height direction which in turn is smaller than the length which is measured in the longitudinal direction 17.

Each centring strip 63 is arranged next to the lower edge surface 58 which is formed on the same lateral lid edge section 57, in the transverse direction 18 on the side which faces the storage space 23. The centring strip 63 herein projects downwards beyond the adjacent lower edge surface 58. It therefore projects downwards beyond the lower edge surface 58. Herein, it ends with a lower longitudinal edge 66 which faces the housing lower part 24, at a height distance to the lower edge surface 58.

The centring strip 63 has a longitudinal design with a longitudinal axis 65. In the closure position of the housing lid 25, this longitudinal axis 65 is at least essentially directed equally with the longitudinal axis 17 of the container housing 15. As one can clearly derive from FIG. 4, each centring strip 63 considered in the closure position of the housing lid 25 comprises a rear terminating edge 67 which is arranged adjacently to the rear wall 33 of the housing lower part 24 and a front terminating edge 68 which is adjacent to the front wall 32.

When the housing lid 25 assumes the closure position, each centring strip 63 immerses from above into the housing lower part 64 and projects into a region which lies directly next to the assigned side wall 34 of the housing lid 25 in the transverse direction 18. There is therefore an overlapping between the centring strip 63 and the adjacent side wall 34 in the height direction 16, and specifically preferably over at least approximately the entire length of the centring strip 63.

The constructional design can be selected such that a slight air gap 72 remains between the side wall 34 and the centring strip 63 in the closure position of the housing lid 25. Alternatively, a design to the extent that the centring strip 63 with its strip outer surface 73 which faces the adjacent side wall 34 bears in a direct manner on the side wall inner surface 55 is however also possible. The bearing contact force however is so slight than the two parts can easily slide on one another on pivoting the housing lid 34.

The design which has been outlined above has the effect that on pivoting the housing lid 25 which assumes an open position in the direction of the closure position, each centring strip 63 immerses from above past the upper edge surface 54 of the adjacent side wall 34 into the housing lower part 24, and specifically with an overlapping with respect to the side wall 34 which increases from the rear side 7 to the front side 6. Inasmuch as the upper edge surfaces 54 of the side walls 34 are not aligned exactly parallel to the lower edge surfaces 58 of the lateral lid edge sections 57 on account of a distorted structure of the housing lower part, given the immersing procedure the centring strip 63 presses against the side wall inner surface 55 in the transverse direction 18 and aligns the side wall 34 with respect to the housing lid 25 in a manner such that the housing lid 25 is led into the closure position in a centred manner.

As is particularly well evident from FIG. 4, each centring strip 63 on its rear terminating edge 67 is expediently chamfered and/or convexly rounded, so that coming from the housing lid 25 it has a downwardly directed course which is simultaneously directed to the front. This favours the initial threading into the housing lower part 24 when the closure procedure of the housing lid 25 begins in an open position, in which—for example according to FIGS. 5 and 6—each centring strip 63 lies completely outside the housing lower part 24.

For threading or for the initial immersing of the centring strips 63 into the housing lower part 24, it is further necessary for each centring strip 63 on the lower longitudinal side which is assigned to the lower longitudinal edge 66 to comprises an introduction section 74 which tapers downwards in the direction of the housing lower part 24. It is preferably the case of a wedge-like tapering. The introduction section 74 extends at least approximately over the entire length of centring strip 63 and preferably takes up only a part of the width of the centring strip 63 which is measured in the height direction 16. It is characterised in that the part surface 73*a* of the strip outer surface 73 which is located on it distances itself from the adjacent side wall inner surface 55 in a continuous manner with an increasing approach onto the base wall 26 and forms an introduction slant which is inclined with respect to the strip main plane 64.

It is considered to be useful if the width of each centring strip 63 measured in the height direction 16 of the container housing 15 gradually reduces from the rear side 7 to the front side 6 in a manner such that its height-related protrusion with respect to the adjacent lower edge surface 58 of the lateral lid edge section 57 reduces to the front side 6 of the container housing 15. The lower longitudinal edge 66 towards the front side 6 therefore increasingly approaches the lower edge surface 58 which is arranged thereabove.

Several relative positions of a centring strip 63 which are assumed at different pivoting positions of the housing lid 25 with respect to the housing lower part 24 are indicated in FIG. 4 in a dot-dashed manner. Hereby, the increasing overlapping of the centring strip 63 with the adjacent side wall 34 with the closing pivoting of the housing lid 25 can be easily recognised.

The housing lid 24 is expediently pivotable into at least one open position to the extent that its centring strips 63 are no longer in engagement with the housing lower part 34. With the closing pivoting, the engagement into the housing lower part 24 does not begin until at a certain opening pivoting angle 13. This expediently is at least 45 degrees.

A design concerning with which an at least partial engagement of the centring strips 63 into the housing lower part 24 is present in the complete pivoting region between the closure position and an opening pivoting angle of 30 degrees is particularly advantageous.

The housing lid 25 is preferably designed such that it comprises a front lid wall 75 which is above the front wall 32 of the housing lower part 24, a rear lid wall 76 which lies opposite with respect to this in the longitudinal direction 17 and two lateral lid walls 77 which lies opposite one another in the transverse direction 18.

Expediently, the four lid walls 75, 76, 77 together form a frame-like lid peripheral wall 78 which projects downwards coming from the edge of a lid wall 79 of the housing lid 25 which is assigned to the upper side 5. In the closure position of the housing lid 25, the lid wall 79 extends essentially in a plane which is at right angles to the height axis 16. The housing lid 25 is therefore designed in a pan-like manner and delimits a lid interior 82 which is open to the bottom and which connects at the top to the storage space 23.

The lateral lid walls 77 each run at least essentially in a plane which is at right angles to the transverse axis 18.

Each centring strip 63 preferably extends in the same plane as the lateral lid wall 77 which is assigned to the same lateral lid edge section 57. By way of example, each centring strip 63 forms a lengthening section of the lateral lid wall 77 which as one piece connects at the bottom onto the assigned lateral lid wall 77 in the height direction 16.

Preferably, the housing lid 25 on the lower side of the two lateral lid edge sections 57 each comprises a lower end section 83 which is U-shaped in cross section. This U-shaped lower end section 83 extends in the longitudinal direction 17 over the entire length of the housing lid 25. By way of example, it connects at the bottom onto the lateral lid wall 77.

The U-shaped lower end section 83 comprises a U-opening 84 which is open to the bottom. The base surface of this U-opening 84 with regard to the embodiment example forms the inner upper edge surface section 58*a*. The inner U-limb 85 of the lower end sections 83 which faces the storage space 23 is formed by the centring strip 63. It is longer than the outer U-limb 68 of the lower end section 83 which lies further to the outside in the transverse direction 18, the lower end-face of said lower end section with the embodiment example forming the outer lower edge surface section 58*b*. In the closure position of the housing lid 25, the side walls 34 of the housing lower part 24 immerse with their upper end sections into the U-opening 84.

In order to provide the centring strips 63 with a high stability in the transverse direction 18 despite a small wall thickness, it is advantageous if several stiffening webs 88 which are arranged at a distance to one another in the longitudinal direction of the centring strip 63 are integrally formed on the inner surface 87 of each centring strip 63 which faces the storage space 23. The stiffening webs 88 each run in the height direction 16. The exemplary storage container 2 is provided with such stiffening webs 88.

The stiffening webs 88 preferably have such a length in the height direction 16 that they yet also extend along the lateral lid wall 77 which connects onto the centring strip 63 at the top and onto which they are likewise integrally formed as one piece. It is particularly expedient if the stiffening webs 88 extend upwards up to the lid wall 79 and are also connected to this as one piece.

Each stiffening web 88 at least in the region of the centring strip 63 preferably has such a shaping that it increasingly widens in the transverse direction 18 towards the upper side 5.

Optionally, the centring means 62 additionally to the centring strips 63 comprise two centring pins 91 which are located on the lower side of the housing lid 25 in one of the two font lid corner regions 92, in which the lateral lid edge sections 57 each merge into a front lid edge section 59 of the housing lid 25 which lies above the front wall 32 of the housing lower part 24 in the closure position.

Each centring pin 91 projects downwards beyond the lower edge surface 58 of the housing lid 25, so that in the closure position of the housing lid 25 it immerses from above into the housing lower part 24. Herein, each centring pin extends adjacently to the peripheral wall 27 of the housing lower part 24 in a manner such that it can support itself on this peripheral wall 27 transversely to the height axis 16.

Preferably, the position of the centring pins 91 is matched to the shaping of the housing lower part 24 such that the centring pins 91 bear on the inner surface 93 of the peripheral wall 27 which face the storage space 23, in the closure position of the housing lid 25. Herein, it is advantageous if a bearing contact is given at least on the side wall inner surface 55. However, it is advantageous if each centring pin 91 additionally or alternatively bears on a curved transition inner surface 94 of the peripheral wall 27 which is formed on the front corner regions 8 and which connects the side wall inner surface 55 to the surface section of the inner surface 93 of the peripheral wall 27, said surface section being formed on the front wall 32 at the inside.

Alternatively, the constructive design can also be effected such that in the non-loaded neutral state of the storage container 2, a slight transverse distance is present between the centring pins 91 and the peripheral wall 27 and a direct contact only arises when the housing lower part 24 is not centrically aligned with respect to the housing lid 25 in an exact manner on account of the distortion situation.

The centring pins 91 preferably have an end section which tapers downwards, by which means an immersing into this housing lower part 24 in an unerring manner is ensured on closing the housing lid 25, even in a greatly distorted state of the housing lower part 24.

Preferably, the surface sections of the inner surface 93 of the housing lower part 24, said surface sections cooperating with the centring pin 91 in a supporting manner, are formed in the inside of a centring recess 105 which is open to the upper side 5 and of which one is formed on the peripheral wall 27 at the inside in the two front corner regions 8. By way of this, the centring pins 91 which are integrated into the housing lid 24 in a single-piece manner are shielded from the storage space 23 when they project into the housing lower part 24 in the closure position of the housing lid 25.

Each centring pin 91 is expediently arranged in the axial extension and at a certain distance in front of centring strip 63 which is assigned to the same lateral lid edge section 57. Each centring pin 91 is arranged in front of the front terminating edge 69 of the adjacent centring strip 63 towards the front side 6.

Each centring pin 91 can be designed as one part or longitudinally divided in a multi-part manner. Concerning the embodiment example, a longitudinally divided construction shape is realised. Hereby, each centring pin 91 is formed by two tooth-like projections 91*a*, 91*b* which are arranged longitudinally next to one another at a distance transversely to the height direction 16 and which each have a flat shape and are aligned such that their main extension planes 106, 107 run at right angles to one another.

Figure 2:
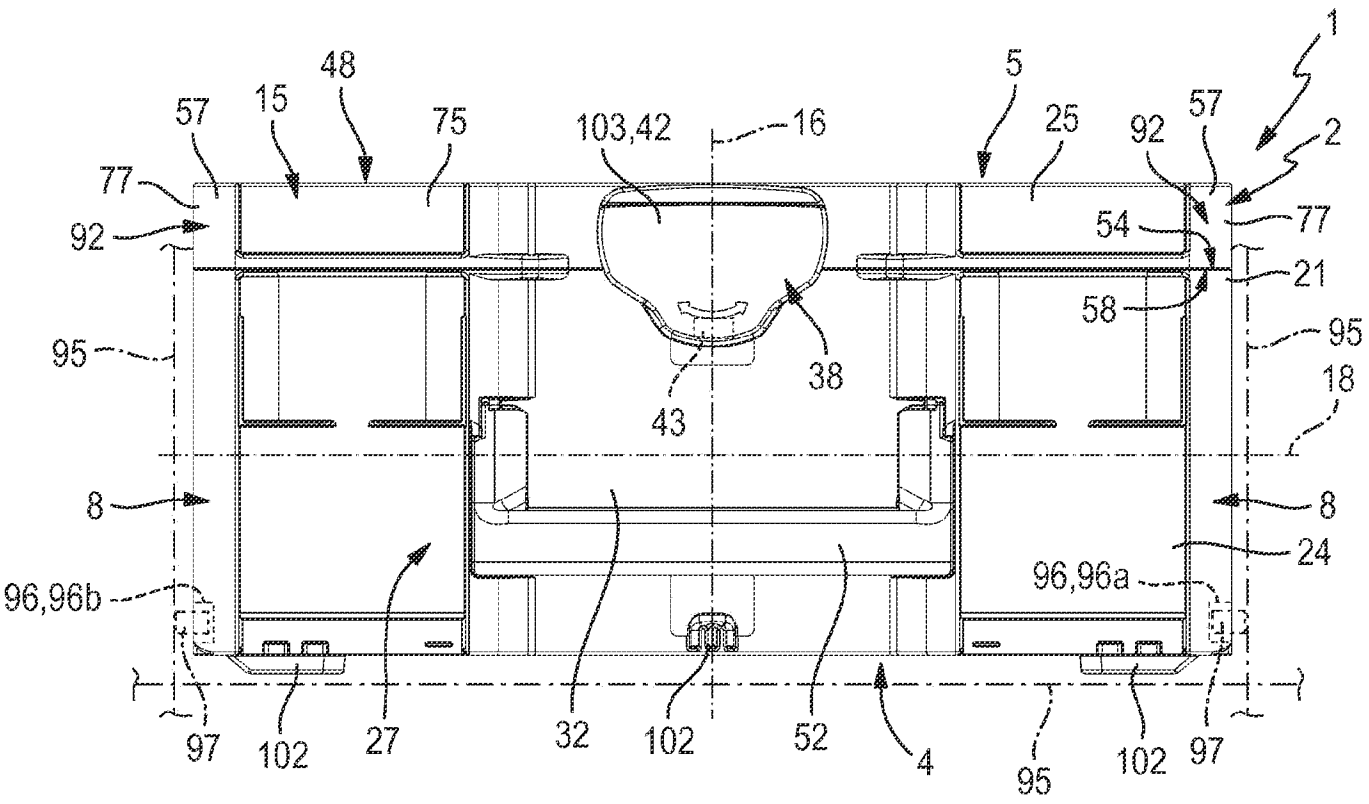

An advantageous design of the storage device 1 comprises a shelf structure 95 which is merely indicted in a schematic dot-dashed manner in FIG. 2 and is designed in order to mount at least one storage container 2, 2*a*, 2*b* whilst not in use. The shelf structure 95 provides the possibility of receiving each storage container 2 in a manner in which it can be pulled out in the manner of a drawer. Such a shelf structure 95 can be installed for example in a workshop or in a service vehicle.

In this context, the storage container 2 at the outer side of the housing lower part 24 comprises a guide device 96, via which it can be brought in a linearly displaceable manner into engagement in a releasable manner by way of a counter guide device 97 of the storage device 1 which is arranged on the shelf structure 95. By way of example, the guide device 96 comprises a guide rail 96*a*, 96*b* on the outer side of each side wall 34 in the region of the lower side 4. The counter guide device 97 has two counter guide rails 97*a*, 97*b* which are arranged distanced to one another on the shelf structure 95 in a manner such that the storage container 2 can be brought into engagement with them from a face side by way of its guide rails 96*a*, 96*b*. The guide rails 96*a*, 96*b* and the counter guide rails 97*a*, 97*b* are matched to one another such that the storage container 2 can be inserted into the shelf structure 95 and can be pulled out of the shelf structure 95, in its longitudinal direction 17. The first handle 52 can be used for this handling.

The guide device 96 is expediently integrated as one piece into the housing lower part 24 which consists of plastic material.

Preferably, several storage containers 2 are stackable onto one another in the height direction 16, so that a container stack 98 which consists of at least two storage containers 2 stacked upon one another results, as is shown in FIG. 10 by way of example. In the stacked state, a respective upper container 2 is seated with its lower side 4 on the upper side 5 of a further container 2, 2*b* which is arranged therebelow.

Expediently, each storage container 2 is the region of its lower side 4 has a lower coupling device 102 which is designed for example in a manner which is evident from FIG. 2. Furthermore, each storage container 2 on the upper side 5 has an upper coupling device 103 whose preferred design is evident from FIG. 1. The two coupling devices 102, 103 are adapted to one another such that on account of their interaction, the storage containers 2 which are directly stacked on one another can be releasably coupled to one another in a manner in which they cannot be lifted from one another. Such a coupled state is shown in FIG. 10. The container stack 98 can then be carried and transported as a unit by way of the upper handle 45 of the uppermost storage container 2.

The locking means 38 which are explained further above preferably belong at least partly to the two coupling devices 102, 103. By way of example, the rotary bar 42 can be rotated into a coupling position which is shown in FIG. 10 at 104 and in which it couples the two storage containers 2 which are stacked onto one another, to one another in a non-liftable manner in the region of the front side 6.

Further constituents of the coupling devices 102, 103 with regard to the illustrated embodiment example are formed by projections which are formed on the lower side 4 and by deepenings which are formed on the upper side 5. In the state of two storage containers 2 stacked onto one another, the projections and deepenings at least partly engage into one another, such that they overlap or engage behind one another transversely to the height direction 16 and likewise effect a coupling of two storage containers 2 which are stacked onto one another, in a manner such that they cannot be lifted from one another, in particular in the region of the rear side 7. The projections are expediently stand feet which serve for placing the storage container 2 on a base.

The invention claimed is:

1. A storage device with at least one storage container which comprises a container housing which has an at least essentially rectangular outline and which has a height direction which runs between a lower side and an upper side, a longitudinal direction which runs between a front side and a rear side and is at right angles to the height direction and a transverse direction which is at right angles to the height direction as well as to the longitudinal direction, wherein the container housing comprises a housing lower part which delimits a storage space and which has a base wall and a peripheral wall, said peripheral wall projecting upwards from the edge of the base wall in the height direction and consisting of a front wall, of a rear wall which is distanced with respect to the front wall in the longitudinal direction and of two side walls which are distanced to one another in the transverse direction, wherein an upper end section of the peripheral wall frames an access opening for the storage space, and wherein the container housing further comprises a housing lid, said housing lid being pivotably mounted on the housing lower part in the region of the rear side about a pivot axis running in the transverse direction and by way of a pivoting movement effected relative to the housing lower part being able to be selectively brought into a closure position which closes the access opening or into opening positions which are pivoted upwards to a greater or lesser extent whilst releasing the access opening and the housing lid above one of each side wall of the housing lower part comprising a lateral lid edge section, on whose lower side a downwardly facing lower edge surface is formed, said edge surface in the closure position at least partly covering an upwardly facing upper edge surface of the side wall of the housing lower part which is arranged therebelow, and wherein the housing lid on the lower side of each of its two lateral lid edge sections comprises a centring strip which projects downwards beyond the lower edge surface and extends in the longitudinal direction of the container housing, said centring strip during a closing pivoting movement of the housing lid, which starts in an open position, immerses from above into the housing lower part next to the adjacent side wall on the inner side facing the storage space and past the upper edge surface of the side wall with an overlapping with respect to the side wall which increases from the rear side to the front side, wherein the housing lid is guidable by the centring strips, which are supportable or supported on the respectively adjacent side wall in the transverse direction, into a closure position which is centred with respect to the housing lower part, and wherein the width of each centring strip which is measured in the height direction of the container housing gradually reduces from the rear side to the front side of the container housing, in a manner such that its height-related protrusion with respect to the adjacent lower edge surface reduces towards the front side of the container housing.

2. The storage device according to claim 1, wherein each centring strip on its rear side which faces the rear side of the container housing comprises a rear terminating edge which in an oblique and/or rounded manner runs downwards and at the same time to the front in the direction of the front side of the container housing.

3. The storage device according to claim 1, wherein each centring strip considered in the closure position of the housing lid comprises a rear terminating edge which is arranged adjacently to the rear wall of the housing lower part and a front terminating edge which is arranged adjacently to the front wall of the housing lower part.

4. The storage device according to claim 1, wherein each centring strip on its lower longitudinal side which faces the housing lower part comprises an introduction section which tapers downwards in the direction of the housing lower part and which is chamfered on the outer surface which faces the adjacent side wall.

5. The storage device according to claim 1, wherein each centring strip has a flat shape, wherein its thickness which is measured in the transverse direction of the container housing is smaller than its width which is measured in the height direction and which width in turn is smaller than its length which is measured in the longitudinal direction.

6. The storage device according to claim 1, wherein the centring strips are shaped such that at least in an open position of the housing lid which is pivoted upwards by 45° with respect to the housing lower part they are located completely outside the housing lower part and/or wherein they immerse at least partially into the housing lower part in the complete pivoting region between the closure position and an open position of the housing lid which is pivoted upwards by at least 30°.

7. The storage device according to claim 1, wherein the centring strips with the outer surface facing the respectively adjacent side wall of the housing lower part of their section which immerses into the storage space, are able to bear in a slidingly displaceable manner on the side wall inner surface facing the storage space of the adjacent side wall of the housing lower part.

8. The storage device according to claim 1, wherein the upper edge surface of each side wall has a stepped cross-sectional contour and is composed of at least two upper edge surface sections which are arranged next to one another in the transverse direction and at the same time offset to one another in the height direction of the container housing, wherein the housing lid lies on at least one of these upper edge surface sections in the closure position.

9. The storage device according to claim 1, wherein the housing lid on the lower side of its two lateral lid edge sections comprises a lower end section which is U-shaped in cross section, has differently long U-limbs and is open to the bottom and into whose U-opening the side wall which is arranged therebelow immerses with its upper end section in the closure position of the housing lid, wherein the inner U-limb which projects further downwards in comparison to the outer U-limb is formed by the centring strip.

10. The storage device according to claim 1, wherein several stiffening webs which are arranged at a distance to one another in the longitudinal direction of the respective centring strip are integrally formed on the inner surfaces of the two centring strips which face the storage space.

11. The storage device according to claim 1, wherein the housing lower part as well as the housing lid are manufactured of a plastic material, wherein the centring strips are integrated into the housing lid as one piece.

12. The storage device according to claim 1, wherein the housing lid on the lower side of the two front lid corner regions, which lie between the two lateral lid edge sections and the front lid edge section which is arranged above the front wall of the housing lower part, each comprises a downwardly projecting centring pin which projects beyond the lower edge surface of the lateral lid edge sections of the housing lid and which in the closure position of the housing lid immerses from above into the housing lower part in a manner supportable or supported with respect to the peripheral wall transversely to the height direction.

13. The storage device according to claim 12, wherein each centring pin in the closure position of the housing lid immerses into a centring recess which is open to the top and is arranged at the inside of the peripheral wall of the housing lower.

14. The storage device according to claim 12 wherein each centring pin is arranged on the housing lid in the axial extension and at a distance in front of the centring strip which is assigned to the same lateral lid edge section.

15. The storage device according to claim 1, wherein the at least one storage container at the outside on the upper side of its housing lid comprises an upper handle.

16. The storage device according to claim 1, wherein the at least one storage container housing at the outside on the front wall of the housing lower part comprises a front handle.

17. The storage device according to claim 1, wherein the at least one storage container on the outer side of the housing lower part comprises a guide device, via which it can be received in a shelf structure in a manner such that it can be pulled out.

18. The storage device according to claim 1, further comprising several storage containers which each on their container housing in the region of the lower side comprise a lower coupling device and in the region of the upper side an upper coupling device, wherein these two coupling devices are adapted to one another in a manner such that storage containers which are directly stacked onto one another in the height direction, by way of the interaction of the upper coupling device of the respective lower storage container and of the lower coupling device of the respective upper storage container can be releasably coupled to one another in a manner in which they cannot be lifted from one another.

19. The storage device according to claim 12, wherein each centring pin is integrated into the housing lid as one piece.

20. The storage device according to claim 15, wherein the upper handle which is pivotably mounted on the housing lid in a manner such that it can be selectively pivoted into a position of non-use which is pivoted onto the housing lid or into a position of use which is pivoted away from the housing lid and projects upwards.

21. The storage device according to claim 16, wherein the front handle is pivotably mounted so that it can be selectively pivoted into a position of non-use which is pivoted onto the housing lower part or into a position of use which is pivoted away from the housing lower part and projects to the front.

* * * * *